US007694949B2

(12) United States Patent
Keane et al.

(10) Patent No.: US 7,694,949 B2
(45) Date of Patent: Apr. 13, 2010

(54) CUSTODIAL LAPPED STREAM MECHANISM

(75) Inventors: Joseph John Keane, Telford, PA (US); Glenn Allen Nester, Pottstown, PA (US)

(73) Assignee: Goss International Americas, Inc, Durham, NH (US)

( * ) Notice: Subject to any disclaimer, the term of this patent is extended or adjusted under 35 U.S.C. 154(b) by 182 days.

(21) Appl. No.: 11/522,744

(22) Filed: Sep. 18, 2006

(65) Prior Publication Data

US 2008/0067740 A1 Mar. 20, 2008

(51) Int. Cl.
*B65H 5/22* (2006.01)

(52) U.S. Cl. ..... 271/3.24; 271/277

(58) Field of Classification Search ..... 271/3.24, 271/204, 277

See application file for complete search history.

(56) References Cited

U.S. PATENT DOCUMENTS

| | | | | |
|---|---|---|---|---|
| 5,292,111 | A * | 3/1994 | Hansch | 270/52.27 |
| 5,527,025 | A | 6/1996 | Schlough | 270/58.06 |
| 5,596,932 | A * | 1/1997 | Honegger | 101/485 |
| 5,931,459 | A * | 8/1999 | Landgren | 271/204 |
| 5,975,280 | A | 11/1999 | Cote et al. | 198/474.1 |
| 6,227,588 | B1 | 5/2001 | Cassoni | 294/104 |
| 6,612,563 | B1 * | 9/2003 | Noll, Jr. | 271/69 |
| 6,619,651 | B2 * | 9/2003 | Mader | 271/82 |
| 6,755,412 | B1 | 6/2004 | Glowner | 271/12 |
| 6,976,427 | B2 | 12/2005 | Becker et al. | 101/408 |
| 6,976,674 | B2 * | 12/2005 | Honegger | 271/204 |
| 7,002,135 | B2 | 2/2006 | Sjogren | 250/221 |
| 2003/0218297 | A1 * | 11/2003 | Honegger | 271/204 |
| 2005/0040322 | A1 * | 2/2005 | Sjogren | 250/223 R |

FOREIGN PATENT DOCUMENTS

| | | | |
|---|---|---|---|
| JP | 07323947 | A * | 12/1995 |
| JP | 2001261208 | A * | 9/2001 |

* cited by examiner

*Primary Examiner*—Patrick H Mackey
*Assistant Examiner*—Howard Sanders
(74) *Attorney, Agent, or Firm*—Davidson, Davidson & Kappel, LLC

(57) ABSTRACT

A device is provided for transferring printed sheet material products including a gripper conveyor having a plurality of grippers for gripping a plurality of printed sheet material products, a sheet conveyor for receiving the plurality of products from the plurality of grippers in a lapped stream, and a plurality of fingers, each finger assigned to one of the plurality of grippers, each finger contacting a first side of one of the plurality of products when a second side of the plurality of products is in contact with the sheet conveyor. A method is also provided.

16 Claims, 6 Drawing Sheets

CUSTODIAL LAPPED STREAM MECHANISM

BACKGROUND

The present invention relates generally to newspaper delivery systems, and more particularly to conveyors transporting lapped or shingled streams.

U.S. Pat. No. 6,227,588 B1 discloses a gripper assembly for clamping an article having a first clamp member mounted on a first shaft defining a first axis, a second clamp member, an actuator for pivoting said first clamp member relative to said second clamp member around said first axis from an open position to a closed position in which said gripper assembly is able to clamp an article, said actuator having a follower link being rotatably mounted on a second shaft defining a second axis different to said first axis, said actuator being coupled to said first clamp member by at least one guided spring.

U.S. Pat. No. 7,002,135 B2 discloses standard photocell sensors to detect the presence or absence of each newspaper held in a gripper which is located external to and upstream relative to the stacker.

BRIEF SUMMARY OF THE INVENTION

The present invention provides a device for transferring printed sheet material products comprising:

a gripper conveyor having a plurality of grippers for gripping a plurality of printed sheet material products;

a sheet conveyor for receiving the plurality of products from the plurality of grippers in a lapped stream; and a plurality of fingers, each finger assigned to one of the plurality of grippers, each finger contacting a first side of one of the plurality of products when a second side of the plurality of products is in contact with the sheet conveyor.

The present invention also provides a method for transporting printed sheet material products comprising the steps of:

gripping products and transporting products along a gripper conveyor;

applying pressure to the products with a finger as the products are deposited onto a sheet conveyor in a lapped manner; and transporting the products further using the sheet conveyor.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Figure 1:
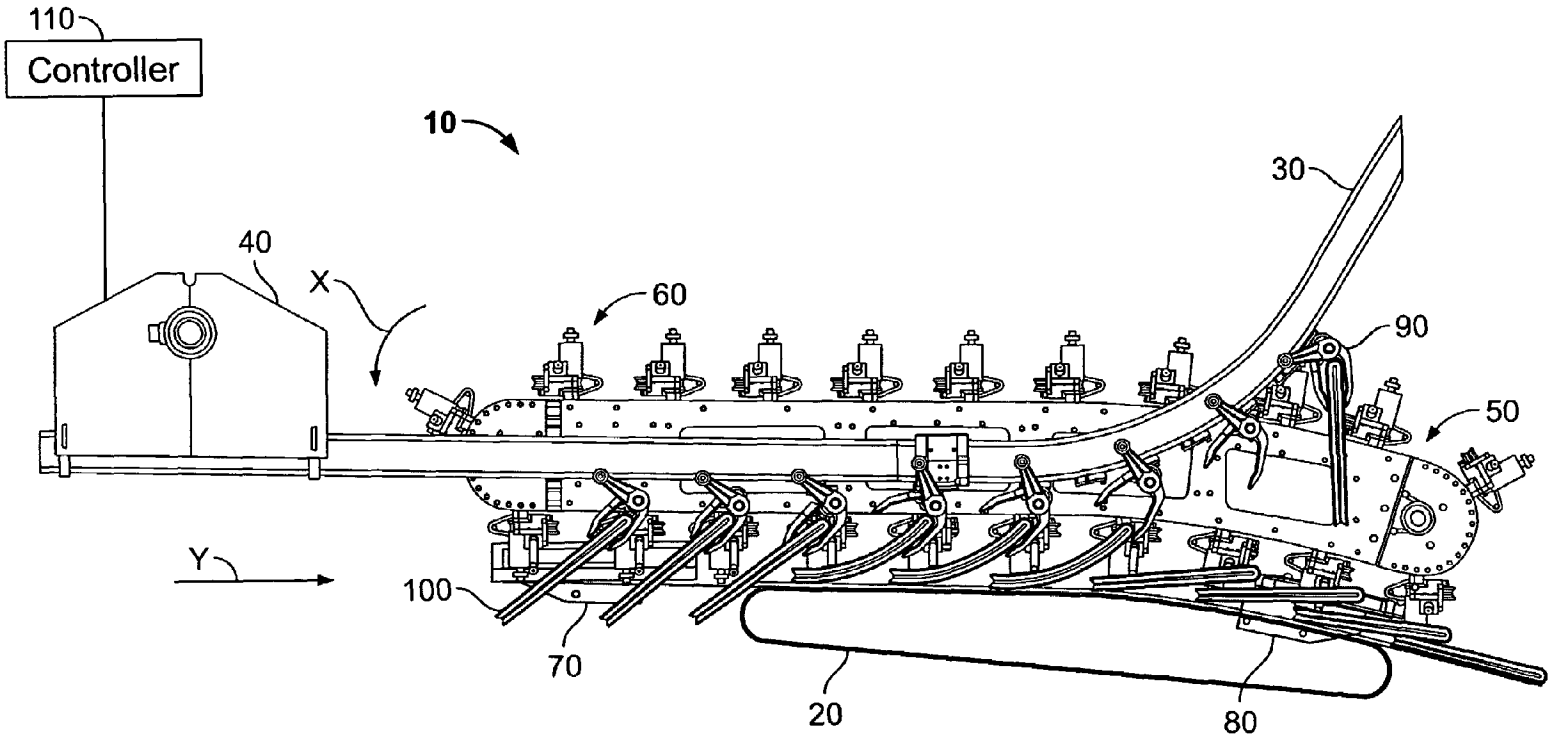
FIG. 1 shows a transport device according to the present invention.

FIG. 1 shows a preferred embodiment of a transport device including a sheet conveyor, such as belt 20, a gripper conveyor 30, a tracking device 40 and a drive assembly 50. A plurality of grippers 90 are mounted onto conveyor 30. Grippers 90 transport products 100 in a direction Y. Belt 20 transports products 100 further downstream in direction Y when products 100 are released by grippers 90. A plurality of holding devices 60 are mounted to drive assembly 50 and rotate in a counterclockwise direction X. Cam devices 70, 80 actuate each holding device 60. A controller 110 provides synchronization, phasing, actuation and counting functions and transmits outputs to devices further downstream for processing.

Figure 2:
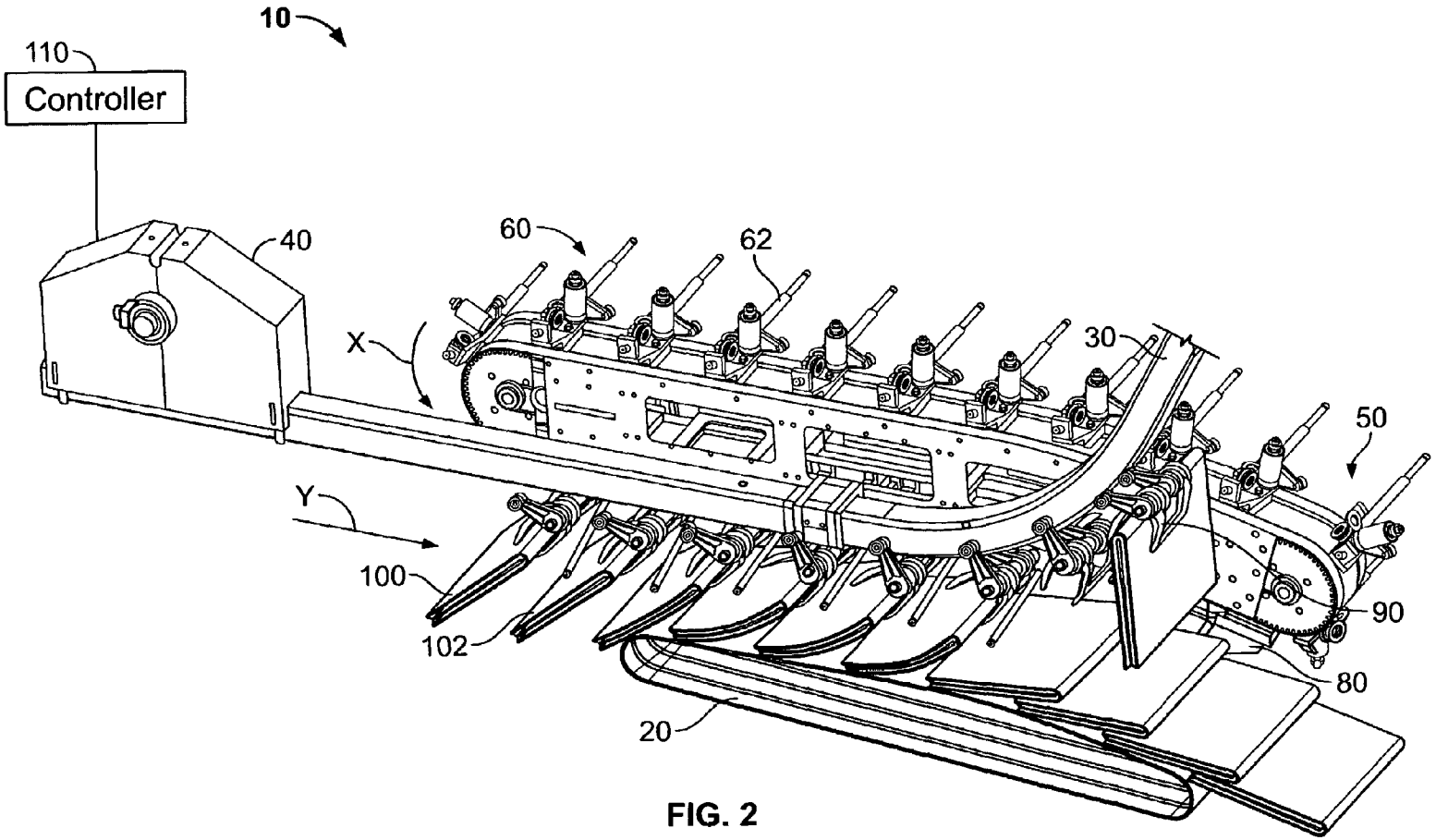
FIG. 2 shows another view of the transport device.
Figure 3:
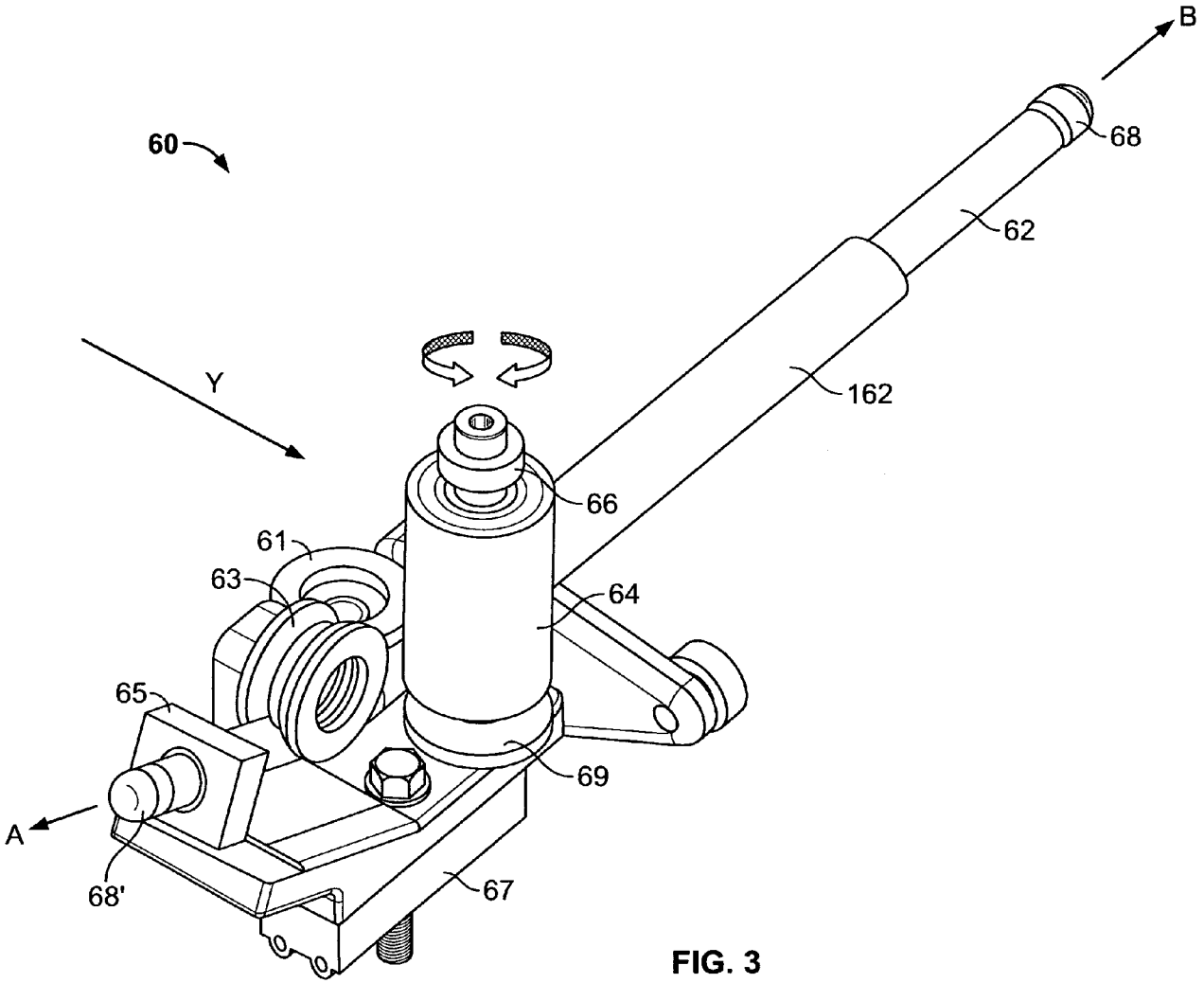
FIG. 3 shows a holding device of the transport device.

Each holding device 60 has a flexible finger 62, as shown in FIGS. 2 and 3, movable in direction A and B. Fingers 62 extend in a direction A when cam device 70 (FIG. 1) actuates holding device 60. Fingers 62 apply pressure to a top surface 102 of product 100 in order to provide support while products 100 transition onto belt 20, are released by grippers 90 and are arranged in a lap or shingled stream configuration. Synchronization of the conveyor 30 and the extension of finger 62 maintain spacing of products 100 on belt 20. Velocities of conveyor 30, belt 20, and drive assembly 50 are synchronized with each other.

Holding device 60 is shown in more detail in FIG. 3. A grooved roller 64 is rotatably mounted onto a base 67. Grooved roller 64 rotates in the clockwise or counterclockwise direction causing finger 62 to extend in direction A or retract in direction B, respectively. Idle rollers 61, 63, a tube 162 and a block 65 guide finger 62 as finger 62 extends and retracts. End caps 68, 68' prevent finger 62 from sliding out of holding device 60. As grooved roller 64 interacts with cam device 70, (FIGS. 4-6) via bearing 66, grooved roller 64 rotates in the clockwise direction. Grooved roller 64 via groove 69 causes finger 62 to move in direction A thereby extending finger 62 to contact a top surface 102 of product 100 (FIG. 2). When grooved roller rotates in the counterclockwise direction, due to interaction with cam device 80 (FIG. 1), finger 62 retracts in a direction B.

Figure 4:
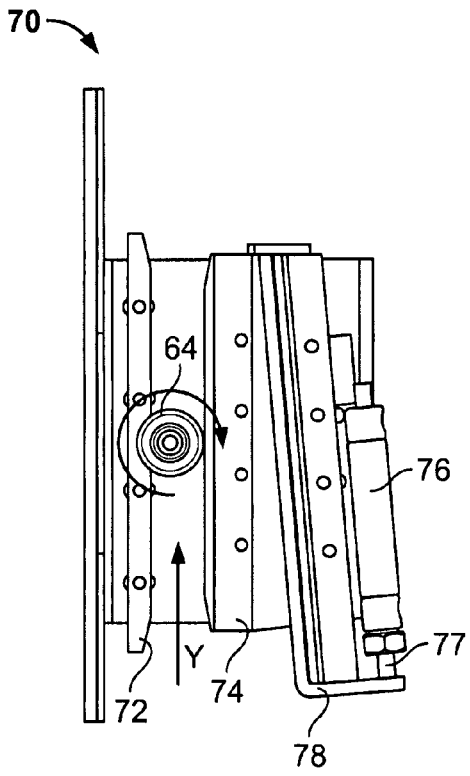
FIGS. 4, 5 and 6 show a cam device of the transport device.
Figure 5:
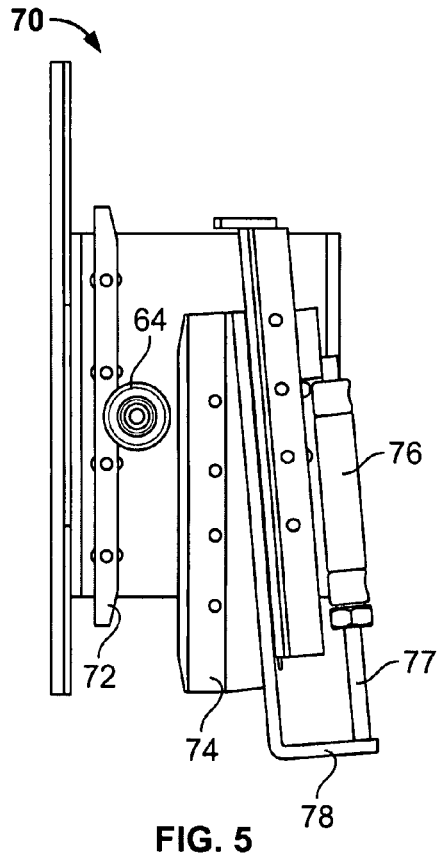
Figure 6:
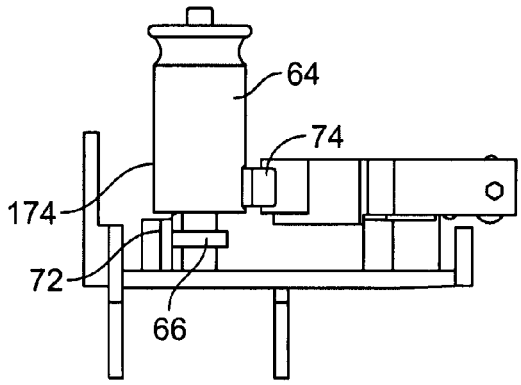

FIGS. 4 to 6 show cam device 70 acting with grooved roller 64. Holding device 60 moves in the direction Y of flow as it rotates around drive assembly 50 in direction X (FIG. 1). A first cam 72 applies pressure to bearing 66 while a second cam 74 contacts grooved roller 64, causing grooved roller 64 to rotate clockwise, extending shaft 62 in direction A (FIG. 3). Cam 74 is attached to a frame 78. Attached to another side of frame 78 is linear actuator 76 including a shaft 77. As shown in FIG. 5, when linear actuator 76 is activated, shaft 77 extends pushing cam 74 via frame 78 away thereby disengaging grooved roller 64. When cam 74 is in a disengaged position cam 14 does not contact grooved roller 64 so there is no rotary movement of grooved roller 64. Cam device 80 (FIG. 1) works in a similar manner as cam device 70, but on the opposite side 174 of grooved roller 64. Cam 80 retracts shafts 62 in a direction B by reversing the action of cam device 70. Cam devices 70, 80, thus contact grooved rollers 64 on opposite sides with respect to the direction Y of flow. A cam opposite cam 72 can be provided for cam device 80.

Figure 7:
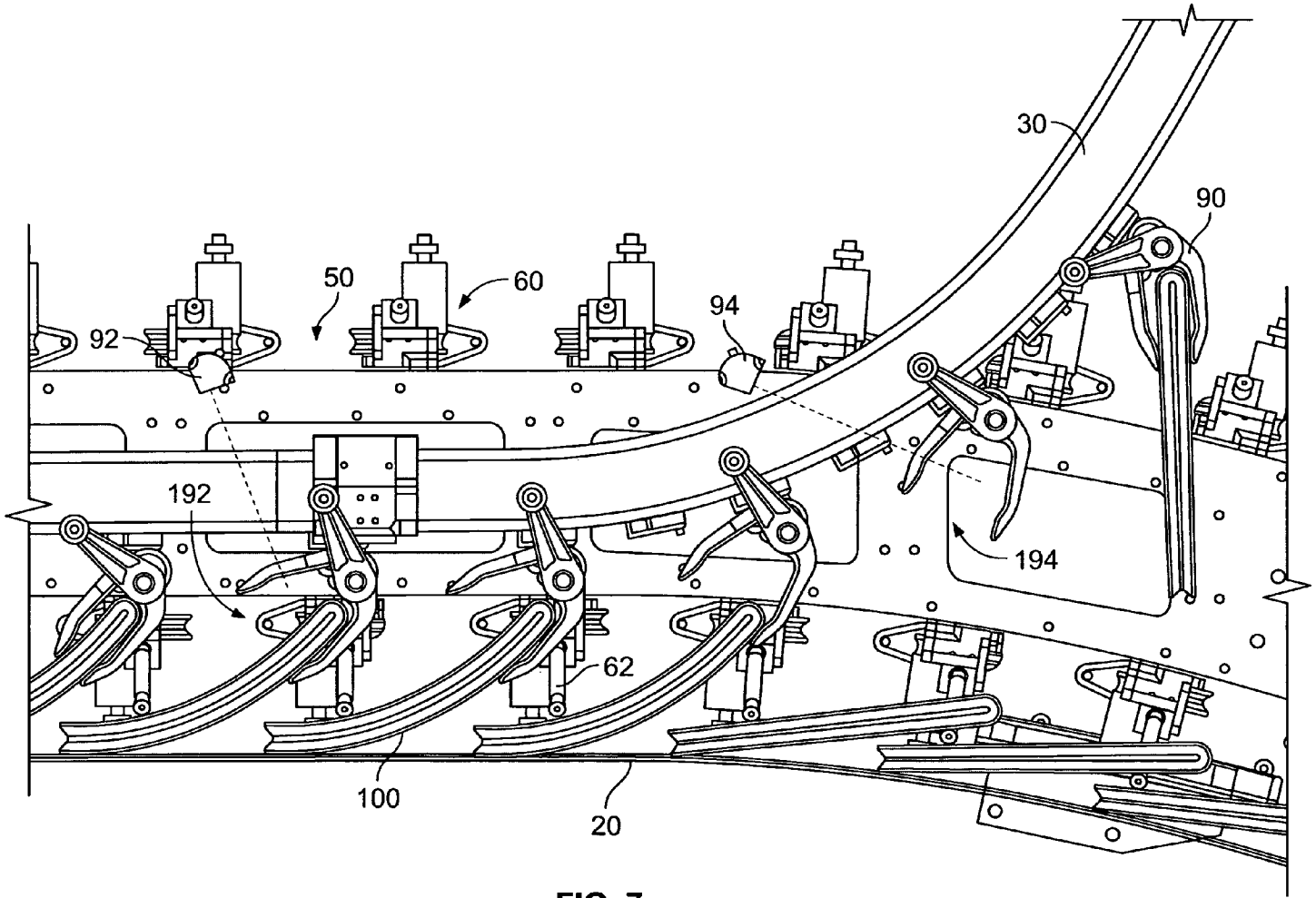
FIG. 7 shows a partial view of the transport device.
Figure 8:
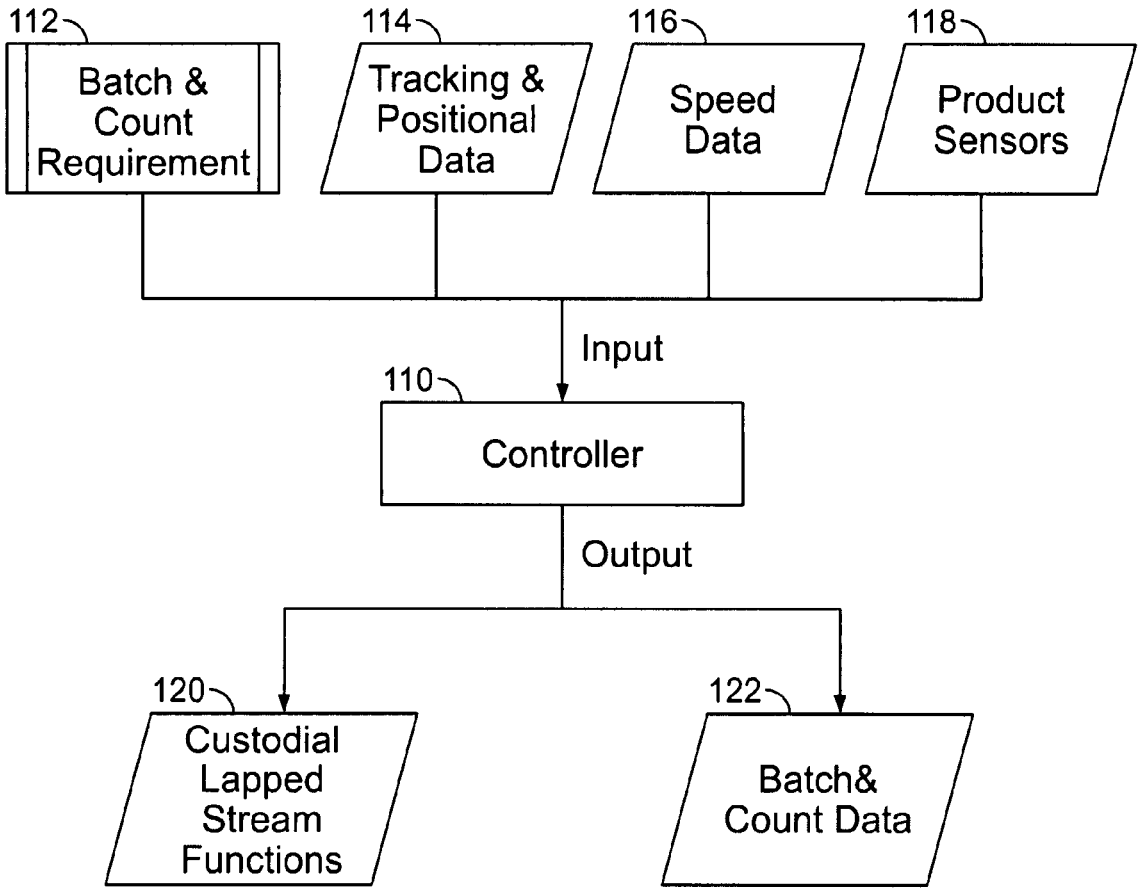
FIG. 8 shows a schematic of a controller of the transport device.

FIG. 7 shows product sensors 92, 94. Product sensors 92, 94 are positioned to identify products 100 in specific locations 192, 194 in conveyor 30. Input 118 from sensors 92, 94 is sent to controller 110, as shown in FIG. 8, and processed in accordance with a batch count requirement 112 obtained from alternative inputs. Controller 110 (FIG. 1) then sends outputs to further downstream devices for further processing.

If a product 100 is detected by sensor 92 at location 192, a count bit is given a unique identifier, stored in a shift register and synchronously tracked via controller 110 through the remaining delivery of product 100. Subsequently, if sensor 94 does not detect a product 100 at location 194 the count bit is retained in the shift register and tracked through the remaining delivery of product 100. Alternatively, if sensor 94 detects a product 100 at location 194, the count bit is ignored in the shift register, location 194 is identified as "empty" and product 100 is not included in the total batch count.

If a product 100 is not detected by sensor 92 at location 192, no information is stored in the shift register. The location 192 is identified as "empty" and not included in the total batch count.

FIG. 8 shows inputs received by controller 100 and outputs transmitted by controller 110. Inputs include a batch and count requirement 112, tracking and positional data 114, speed data 116 and product sensors 118. Outputs include custodial lapped stream functions 120 and batch and count data 122.

The term "product" as defined herein, may include a single sheet or multi-sheet printed product. Products may also have inserts and be referred to as packages or newspapers. The finger preferably is flexible. The flexibility properties can be chosen to accommodate varying product thicknesses in addition to device damage control if an asynchronous event occurs.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A device for transferring printed sheet material products comprising:

a gripper conveyor having a plurality of grippers for gripping a plurality of printed sheet material products;

a sheet conveyor for receiving the plurality of products from the plurality of grippers in a lapped stream; and a plurality of fingers, each finger corresponding to one of the plurality of grippers, each finger contacting a first side of one of the plurality of products when a second side of the plurality of products is in contact with the sheet conveyor so that the product is supported against the sheet conveyor by the corresponding finger as and after the gripper releases the product to form the lapped stream on the sheet conveyor.

2. The device as recited in claim 1 further comprising a sensor for detecting a location of at least one of the plurality of products.

3. The device as recited in claim 2 further comprising a further sensor for detecting a second location of the same product.

4. The device as recited in claim 1 wherein the finger is flexible.

5. The device as recited in claim 1 wherein the finger is retractable.

6. The device as recited in claim 1 further comprising a controller for releasing the products from the gripper.

7. The device as recited in claim 6 further comprising a driving device for the fingers and wherein the controller also synchronizes velocities of the gripper conveyor, the sheet conveyor and the driving device.

8. A method for transporting printed sheet material products comprising the steps of:

gripping the products with corresponding grippers and transporting the products along a gripper conveyor;

depositing the products onto a sheet conveyor in a lapped manner as the products are released from the grippers;

applying pressure to the products with a finger as and after the products are deposited so that the products are supported against the sheet conveyor by the corresponding finger after being deposited thereon; and transporting the products further using the sheet conveyor.

9. The method as recited in claim 8 further comprising the step of sensing a first location of selected one of the products.

10. The method as recited in claim 9 further comprising the step of sensing a second location of the selected one product.

11. The method as recited in claim 8 further comprising the step of counting the products.

12. The method as recited in claim 8 further comprising the step of determining a misfeed.

13. The method as recited in claim 8 further comprising the step of tracking the products.

14. The method as recited in claim 13 wherein the products are tracked using positional data.

15. The method as recited in claim 8 further comprising the step of processing batch or count data of the products.

16. The method as recited in claim 8 further comprising the step of transmitting outputs to devices further downstream.

* * * * *